United States Patent [19]

Zumbusch

[11] Patent Number: 4,639,203

[45] Date of Patent: Jan. 27, 1987

[54] ROTARY FLUID PRESSURE DEVICE HAVING FREE-WHEELING CAPABILITY

[75] Inventor: Steven J. Zumbusch, Eden Prairie, Minn.

[73] Assignee: Eaton Corporation, Cleveland, Ohio

[21] Appl. No.: 748,787

[22] Filed: Jun. 26, 1985

[51] Int. Cl.[4] ..... F01C 1/10; F01C 21/16; F03C 2/08

[52] U.S. Cl. ..... 418/61 B; 418/170; 418/181; 418/259; 91/499; 180/242; 180/308

[58] Field of Search ..... 418/61 B, 69, 181, 270, 418/170, 259; 91/499; 180/242, 308; 254/361

[56] References Cited

U.S. PATENT DOCUMENTS

| | | | |
|---|---|---|---|
| 1,993,721 | 3/1935 | Pigott . | |
| 3,558,245 | 1/1971 | Bolduc | 418/61 B |
| 3,809,949 | 5/1974 | Muncke | 91/473 |
| 3,910,732 | 10/1975 | Lusztig | 418/60 |
| 4,435,130 | 3/1984 | Ohrberg et al. | 417/310 |
| 4,493,622 | 1/1985 | Miller | 418/57 |

*Primary Examiner*—John J. Vrablik

*Attorney, Agent, or Firm*—D. A. Rowe; L. J. Kasper

[57] ABSTRACT

A rotary fluid pressure device is disclosed of the type including housing means defining a fluid inlet (57) and a fluid outlet (61) and including some form of rotary fluid energy-translating displacement mechanism associated with the housing. In one embodiment of the invention, the displacement mechanism comprises a gerotor gear set (17) including a housing member (22), an internally-toothed ring (23), and an externally-toothed star (27). Included is a free-wheeling mechanism (71) having an engagement member (73) and an actuation means (81) operable to move the engagement member between first and second positions. In a first position, the engagement member (73) prevents rotational movement of the ring (23) and the star (27) has its normal and orbital rotational movement to define expanding (28) and contracting (29) fluid volume chambers. In a second position, the engagement member (73) permits the ring (23) to rotate freely and the star (27) and ring (23) rotate together such that the fluid volume chambers neither expand nor contract and no fluid is displaced from the displacement mechanism.

12 Claims, 6 Drawing Figures

ROTARY FLUID PRESSURE DEVICE HAVING FREE-WHEELING CAPABILITY

BACKGROUND OF THE DISCLOSURE

The present invention relates to rotary fluid pressure devices, and more particularly, to such devices which have the capability of operating in a free-wheeling mode.

Although the present invention may be utilized in connection with various types of rotary fluid pressure devices, and to such devices having various types of fluid displacement mechanisms, it is especially adapted for use with low-speed, high-torque orbiting gerotor motors, and will be described in connection therewith.

Low-speed, high-torque gerotor motors have been in commercial use for many years and are especially suited for applications such as vehicle wheel drives, winch drives, and providing rotary torque to various other vehicle implements. Motors of this type have been commercially successful, partially because the gerotor gear set is uniquely suited to provide the desired low-speed, high-torque output in a device which is both compact and relatively inexpensive.

In many of the applications for gerotor motors of the type noted above, it has been found desirable to be able occasionally to operate the motor in some mode other than its normal, operating mode. For example, if the motor is being used to provide torque to the drive wheels of the vehicle, it would be quite useful to be able to operate the motor in a free-wheeling mode when the vehicle is being towed. Typically, when a vehicle which is normally propelled by a gerotor motor is being towed, the output shaft of the motor is being driven by the wheels and, in turn, the gerotor gear set is being driven by the output shaft. In order to avoid the problem of the gerotor motor acting as a dynamic brake, an open center directional control valve is normally used in such applications, thus permitting the fluid to recirculate through the open-center valve during towing.

The fact that the gerotor gear set is being driven during towing has a number of disadvantages. A vehicle which is normally propelled by a gerotor motor is typically towed at a speed much greater than its normal operating speed. Thus, the speed of movement of the gerotor elements and the associated shafts and splines is greater than during normal operation, which can result in damage due to excessive heating of the gerotor elements, splines, etc. Also, this higher speed movement of these elements results in the generation of substantial heat in the fluid which can damage various other parts of the overall hydraulic system. It should be noted that during towing of such a vehicle, the vehicle engine is off, with the result that there is no fan operating to cool the fluid in the vehicle hydraulic system. Finally, because the gerotor motor acts like a pump during such towing operation, a greater amount of horsepower is required to tow such a vehicle.

An attempt by the prior art to provide a motor capable of operating in a free-wheeling mode is illustrated by U.S. Pat. No. 4,435,130. Although the device disclosed therein is described as having a free-wheeling mode, the actual mode of operation is to establish a short-circuit flow path from the inlet port to the outlet port, across the commutating valve. Thus, the commutating valve operates somewhat like the open-center directional control valve referred to previously. Because the motor output shaft is still connected to the rotating element of the gerotor, the volume chambers within the gerotor are still expanding and contracting in response to rotation of the output shaft. Such a motor is not in a true free-wheeling mode, and still suffers from each of the disadvantages described above, at least to some extent.

An arrangement which achieves a true free-wheeling mode of operation is illustrated and described in co-pending application U.S. Ser. No. 697,596, filed in the name of M. L. Bernstrom and S. J. Zumbusch for a "hydraulic motor having free-wheeling and locking modes of operation", assigned to the assignee of the present invention. The arrangement covered by the co-pending application makes it possible to physically disconnect the motor output shaft from the gerotor gear set to achieve free-wheeling.

SUMMARY OF THE INVENTION

Accordingly, it is an object of the present invention to provide a rotary fluid pressure device of the type described herein which is capable of operating in a true free-wheeling mode wherein rotation of the input-output shaft does not result in displacing fluid in the fluid displacement mechanism.

It is a more specific object of the present invention to provide a rotary fluid pressure device in which it is possible for the operator to select a free-wheeling mode of operation wherein there is no relative movement between the normally stationary member of the displacement mechanism and the rotatable member of the displacement mechanism.

The above and other objects of the present invention are accomplished by the provision of an improved rotary fluid pressure device of the type including housing means defining fluid inlet means and fluid outlet means and a rotary fluid energy-translating displacement means associated with the housing means and including a rotary assembly and a normally stationary reaction-torque-receiving means. The normally stationary means is operably associated with the rotary assembly and with the housing means whereby, when the reaction-torque-receiving means is stationary, rotation of the rotary assembly defines expanding and contracting fluid volume chambers. A valve means is operable in response to the rotation of said rotary assembly to communicate fluid from the fluid inlet to the expanding volume chambers and from the contracting volume chambers to the fluid outlet. The device includes an input-output shaft means and means operable to transmit torque between the input-output shaft means and the rotary assembly.

The device is characterized by an engagement member operably associated with the housing means and with the normally stationary reaction-torque-receiving means, and an actuation means operably associated with the engagement member. The actuation means is operable to move the engagement member between two positions. In a first position, the engagement member is disposed to prevent rotational movement of the reaction-torque-receiving means relative to the housing means, whereby the rotary assembly has the normal rotation to define the expanding and contracting fluid volume chambers. In the second position, the engagement member is disposed to permit rotational movement of the reaction-torque-receiving means relative to the housing means, whereby rotation of the rotary assembly does not result in the normal relative movement between the reaction-torque-receiving means and the rotary assembly, and the fluid volume chambers do not expand and contract.

In accordance with a particular embodiment of the invention, the normally stationary reaction-torque-receiving means comprises an internally-toothed outer gear member of an internal gear set and the rotary assembly comprises an externally-toothed inner gear member, the inner and outer gear members normally cooperating to define the expanding and contracting fluid volume chambers in response to rotation of the inner gear member.

DESCRIPTION OF THE PREFERRED EMBODIMENTS

Figure 1:
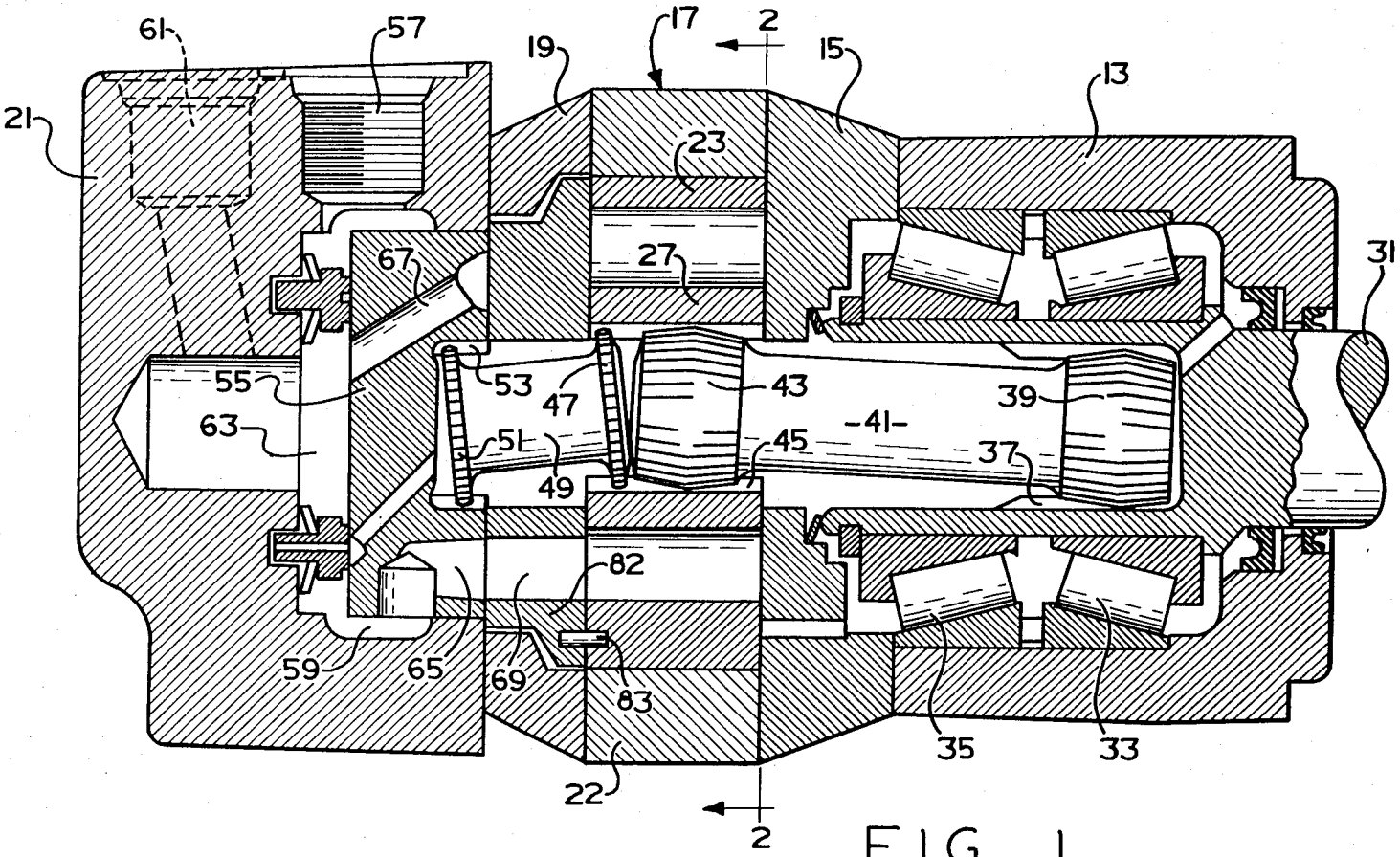
FIG. 1 is an axial cross-section showing a low-speed, high-torque gerotor motor of the type to which the present invention may be applied.

Referring now to the drawings, which are not intended to limit the invention, FIG. 1 illustrates a low-speed, high-torque gerotor motor of the type to which the present invention may be applied and which is illustrated and described in greater detail in U.S. Pat. Nos. 3,572,983 and 4,343,600, both of which are assigned to the assignee of the present invention and are incorporated herein by reference.

Figure 2:
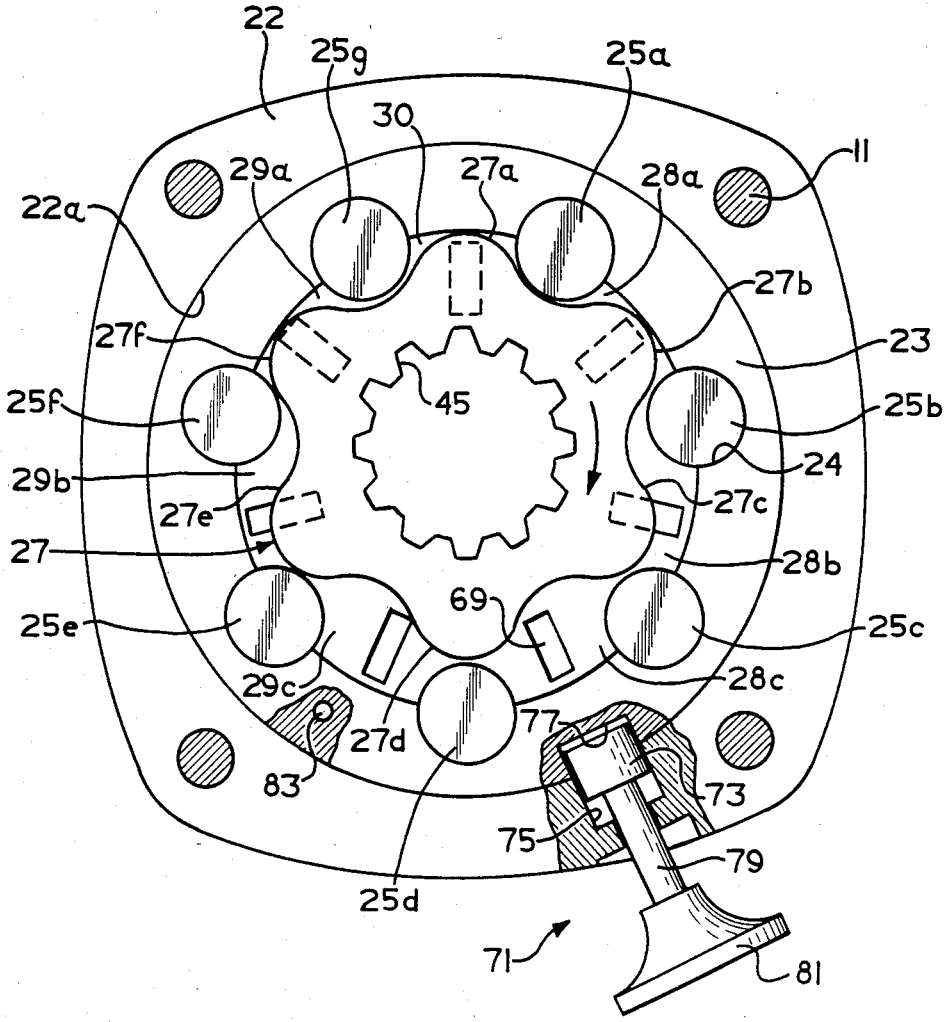
FIG. 2 is a transverse cross-section taken on line 2—2 of FIG. 1, and on approximately the same scale as FIG. 1, illustrating the present invention and the gerotor displacement mechanism in its normal, operating position.
Figure 3:
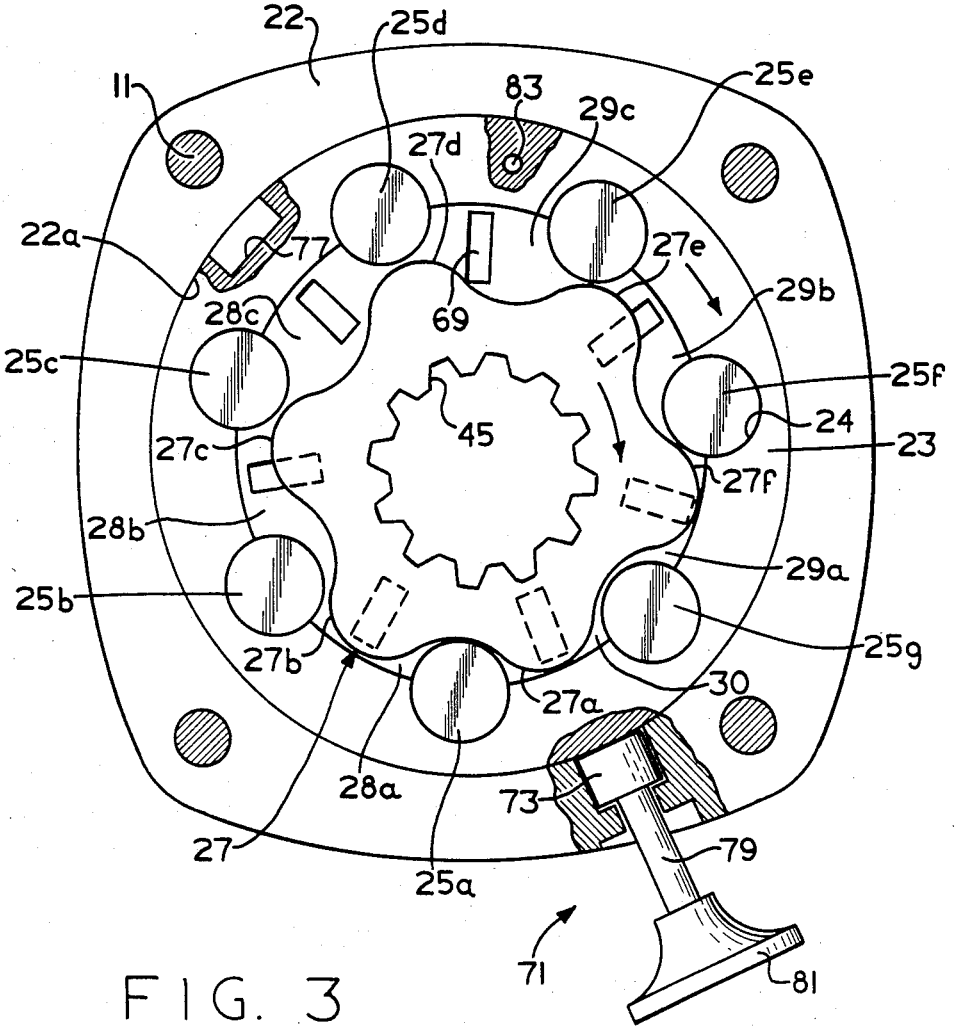
FIG. 3 is a transverse cross-section, similar to FIG. 2, illustrating the gerotor displacement mechanism in its free-wheeling mode of operation, with the elements of the gerotor rotatably displaced from the position shown in FIG. 2.

The hydraulic motor shown in FIG. 1 comprises a plurality of sections secured together, such as by a plurality of bolts 11 (shown only in FIGS. 2 and 3). The motor includes a shaft support casing 13, a wear plate 15, a gerotor displacement mechanism 17, a port plate 19, and a valve housing portion 21.

The gerotor displacement mechanism 17 is well known in the art, and will be described in detail herein only to the extent that it is relevant to the present invention. The displacement mechanism 17 is illustrated herein as a Geroler® mechanism. As may best be seen in FIG. 2, the mechanism 17 comprises a housing member 22 defining a generally cylindrical inner suface 22*a*. Disposed within the housing member 22 is an internally-toothed ring 23 defining a plurality of generally semi-cylindrical openings 24. Disposed within the openings 24 is a plurality of cylindrical members (rollers) 25*a–g*. Eccentrically disposed within the ring 23 is an externally-toothed star 27, having external teeth 27*a–f*. To generalize, the ring 23 has N+1 internal teeth and the star 27 has N external teeth, thus permitting the star 27 to orbit and rotate relative to the ring 23.

For purposes of describing the present invention, it will be assumed that the star 27 orbits counterclockwise within the ring 23, with the result that the star 27 rotates clockwise (see arrow) within the ring 23. This orbital and rotational movement of the star 27, relative to the ring 23 defines a plurality of expanding volume chamber 28*a–c*, a plurality of contracting volume chambers 29*a–c*, and one changeover volume chamber 30. It should be noted that with the star 27 in the position shown in FIG. 2, the expanding and contracting volume chambers 28*a* and 29*a* are the same size as each other, as are the expanding and contracting volume chambers 28*b* and 29*b* and 28*c* and 29*c*. The changeover volume chamber 30 is also referred to as a "minimum" volume chamber because it is at the changeover point that this volume chamber is at its minimum volume.

Referring again to FIG. 1, the motor includes an output shaft 31 positioned within the shaft support casing 13 and rotatably supported therein by suitable bearing sets 33 and 35. The shaft 31 includes a set of internal, straight splines 37, and in engagement therewith is a set of external, crowned splines 39 formed on one end of a main drive shaft 41. It should be noted that the drive shaft 41 is not shown in the transverse cross-sections of FIGS. 2 and 3, merely for simplicity. Disposed at the opposite end of the main drive shaft 41 is another set of external, crowned splines 43, in engagement with a set of internal, straight splines 45, formed on the inside diameter of the star 27. Therefore, in the subject embodiment, because the ring 23 includes seven internal teeth 25, and the star 27 includes six external teeth, seven orbits of the star 27 result in one complete rotation thereof, and one complete rotation of the main drive shaft 41 and the output shaft 31.

As is well known to those skilled in the art, the drive shaft 41 always has its axis disposed at an angle relative to the main axis of the motor, i.e., the axis of the ring 23 and of the output shaft 31. The primary function of the drive shaft 41 is to transmit torque from the gerotor star 27 to the output shaft 31. This is accomplished by translating the orbital and rotational movement of the star 27 into pure rotational motion of the output shaft 31.

Also, in engagement with the internal splines 45 is a set of external splines 47 formed about one end of a valve drive shaft 49 which has, at its opposite end, another set of external splines 51 in engagement with a set of internal splines 53 formed about the inner periphery of a valve member 55. The valve member 55 is rotatably disposed within the valve housing 21. The valve drive shaft 49 is splined to both the star 27 and the valve member 55 in order to maintain proper valve timing therebetween, as is generally well known in the art.

The valve housing 21 includes a fluid port 57 in communication with an annular chamber 59 which surrounds the valve member 55. The valve housing 21 also includes an outlet port 61 which is in fluid communication with a chamber 63 disposed between the valve housing 21 and valve member 55. The valve member 55 defines a plurality of alternating valve passages 65 and 67, the passages 65 being in continuous fluid communication with the annular chamber 59, and the passages 67 being in continuous fluid communication with the chamber 63. In the subject embodiment, there are six of the passages 65, and six of the passages 67, corresponding to the six external teeth of the star 27. The port plate 19 defines a plurality of fluid passages 69 (only one of which is shown in FIG. 1), each of which is disposed to be in continuous fluid communication with the adjacent volume chambers 28*a–c*, 29*a–c* and 30. Motors of the type shown in FIG. 1 are commercially available, and are well known to those skilled in the art, and for any further details regarding the construction or operation of such a motor, reference should be made to the above-incorporated patents.

Referring now primarily to FIGS. 2 and 3, the present invention and the free-wheeling mode provided by the invention will be described. Referring first to FIG. 2, there is included a free-wheeling control mechanism, generally designated 71. The mechanism 71 includes an engagement member 73 which is preferably generally cylindrical and is received within a stepped bore 75 defined by the housing member 22. With the gerotor gear set in the normal, operating position shown in FIG. 2, the radially inward end of the engagement member 73 is received within a cylindrical recess 77 defined by the outer surface of the ring 23. The engagement member 73 further includes a projecting portion 79 which extends out of the bore 75 and is adapted to engage or be attached to an actuation member (handle) 81.

With the mechanism 71 in the position shown in FIG. 2, the inner end of the engagement member 73 is disposed within the recess 77, thus preventing rotational movement of the ring member 23 relative to the housing member 22. As a result, when pressurized fluid is communicated into the expanding volume chambers 28*a*, 28*b* and 28*c*, the pressurized fluid exerts a force on the star 27, causing it to orbit and rotate as described previously. At the same time, as is well known to those skilled in the art, there is a reaction torque which is transmitted to the portion of the ring 23 and the rollers 25*a*, 25*b* and 25*c* which border the expanding volume chambers 28*a*, 28*b* and 28*c*. Thus, in the embodiment of the invention shown in FIGS. 1–3, the star 27 comprises the rotary member and the ring 23 and rollers 25 comprise the reaction-torque-receiving means. Further, it should be noted that the reaction torque transmitted from the pressurized fluid to the ring 23 and rollers 25 is then transmitted by means of the engagement member 73 to the housing member 22 which, typically, is fixed relative to the rest of the motor, and the motor in turn is fixed relative to the vehicle.

Referring now to FIG. 3, in conjunction with FIG. 2, the free-wheeling mode of operation of the present invention will be described. In order to achieve the free-wheeling mode of operation, the operator can move the free-wheeling mechanism 71, by means of the handle 81 to the position shown in FIG. 3 which may be referred to as the free-wheeling or disengaged position. With the mechanism 71 in the disengaged position (i.e., the engagement member 73 is disengaged from the recess 77), the ring 23 is free to rotate within the cylindrical inner surface 22*a*. With the ring 23 free to rotate relative to the housing 22, rotation of the output shaft 31 (e.g., if the vehicle is being towed), will result in rotation of the main drive shaft 41 and rotation of the star 27 and ring 23 together as a unit (see the two arrows in FIG. 3). With the star 27 and ring 23 rotating together, none of the fluid volume chambers are either expanding or contracting. Therefore, each of the volume chambers 28*a*, 28*b*, and 28*c* which are expanding during the normal operating mode of FIG. 2 remain constant in volume when the motor is in the free-wheeling mode of operation as shown in FIG. 3. Similarly, the fluid volume chambers 29*a*, 29*b*, and 29*c* which are contracting with the motor in the normal operating mode also remain constant in volume in the free-wheeling mode of FIG. 3. Finally, the changeover volume chamber 30, which changes from a contracting volume chamber to an expanding volume chamber in the normal operating mode also remains constant, at its minimum volume, with the motor in the free-wheeling mode.

It will be understood by those skilled in the art that in the free-wheeling mode of FIG. 3, because none of the fluid volume chambers are either expanding or contracting, no fluid is pumped out of the gerotor gear set, nor is any fluid drawn into the gerotor gear set. Instead, the entire gerotor gear set turns freely, thus requiring very little horsepower to rotate the output shaft 31. Furthermore, because the normal orbital movement of the star 27 is not occuring, the resulting, relatively high-speed rubbing of parts such as splines does not occur, and much less heat is generated. Finally, because no fluid is being displaced in the gerotor gear set, the hydraulic fluid in the motor is not being overheated, and the fact that there may be no cooling fan operating is much less likely to result in heat damage to various parts of the hydraulic system.

It may be seen by comparing FIGS. 2 and 3 that, in FIG. 3, the ring 23 and star 27 are both rotated approximately 170 degrees from their positions shown in FIG. 2. For example, external tooth 27*a* of the star 27 is still disposed between rollers 25*a* and 25*g*, illustrating that during the free-wheeling mode of operation, there is no movement of the star 27 relative to the ring 23, but instead, the star 27 and ring 23 rotate as a unit.

In the particular embodiment of the invention shown in FIGS. 2 and 3, there is illustrated one simple form of the free-wheeling mechanism 71. However, it will be understood by those skilled in the art that various other forms of the free-wheeling mechanism could be used, and that the actuation means could comprise any number of mechanical, hydraulic, or electrical forms of actuation. Therefore, the particular mechanism 71 is shown by way of example only, and is not an essential feature of the present invention.

Referring again to FIG. 1, in conjunction with FIGS. 2 and 3, it should be noted that, in the preferred embodiment of the present invention, the port plate 19 is not simply one solid, stationary port plate as is typically found in motors of this type. Instead, there is the port plate 19 which actually serves only as an outer, stationary housing, and rotatably disposed within the port plate 19 is a valve plate 82, and it is the rotatable valve plate 82 which defines the fluid passages 69. As shown in FIGS. 1–3, there is a connecting pin 83 (or preferably several) which connects the valve plate 82 for rotation with the ring 23. When the motor is operating in the normal operating mode of FIG. 2, and the ring 23 is stationary the valve plate 82 is also stationary, just as in the case of the conventional prior art gerotor motor.

However, when the motor is in the free-wheeling mode of operation shown in FIG. 3, and the ring 23 is free to rotate, the valve plate 82 rotates with the ring 23. As a result of this common rotation of the ring 23 and valve plate 82, each of the fluid passages 69 remains in the same position, relative to its respective fluid volume chamber (28*a–c*, 29*a–c*, 30). After the motor has completed its operation in the normal operating mode, it is possible to "drive" the gerotor to its engaged position (FIG. 2) by porting a small volume of pressurized fluid through the valve passages 65 and 67 and through the fluid passages 69 to cause the ring 23 to rotate until the recess 77 is in alignment with the engagement member 73. Preferably, the engagement member 73 could be biased toward the engagement position, such that it would move into engagement with the recess 77 whenever the ring 23 would be rotated to the position shown in FIG. 2.

Alternatively, a conventional port plate could be used in which the port plate 19 and all of the fluid passages 69 are always stationary relative to the rest of the motor, and the fluid passages 69 would not rotate with the ring 23. In that alternative embodiment, it would be necessary after the completion of operation in the free-wheeling mode to rotate the ring 23 to the engagement position, such as by towing the vehicle very slowly until the ring 23 would be in the engagement position shown in FIG. 2. It should be clearly understood by those skilled in the art that either of the alternative embodiments described hereinabove is fully within the scope of the present invention.

FIGS. 4–6

Figure 4:
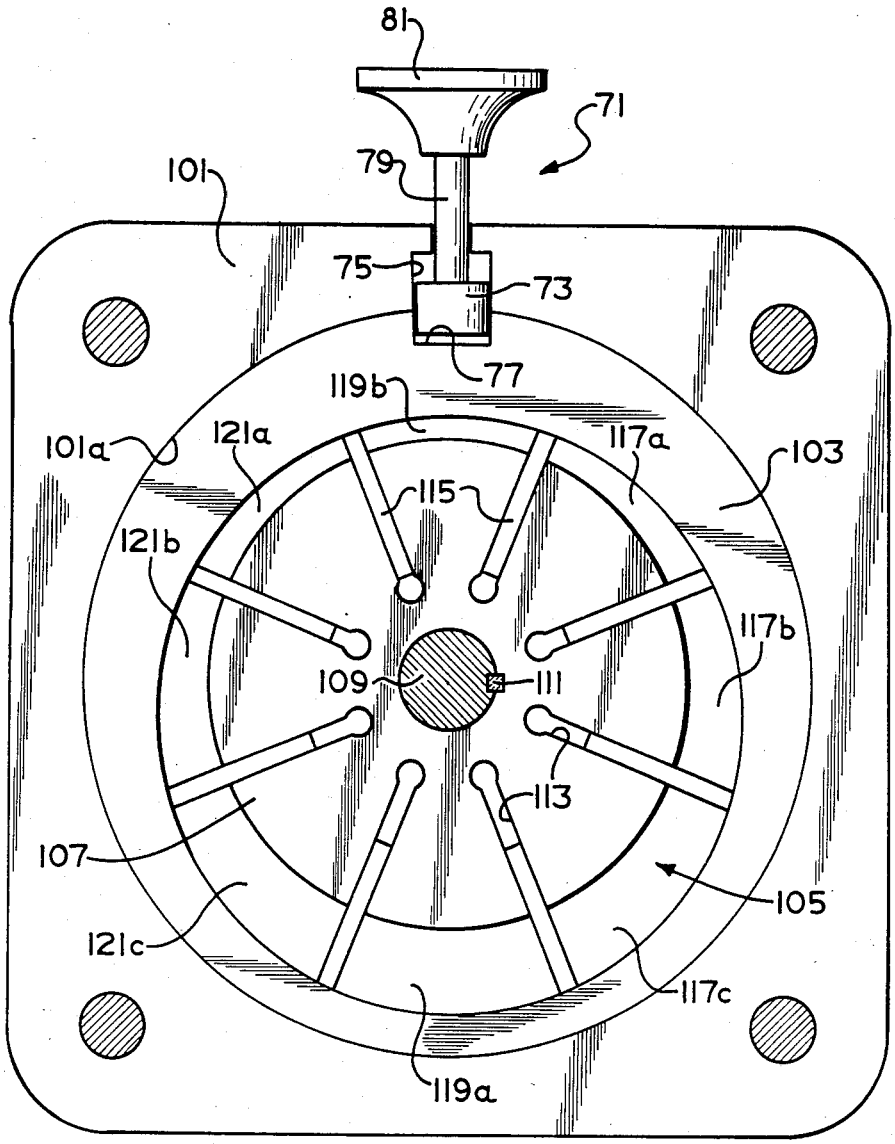
FIG. 4 is a view similar to FIG. 2, but illustrating an alternative embodiment in which the present invention is applied to a displacement mechanism of the sliding vane type.
Figure 5:
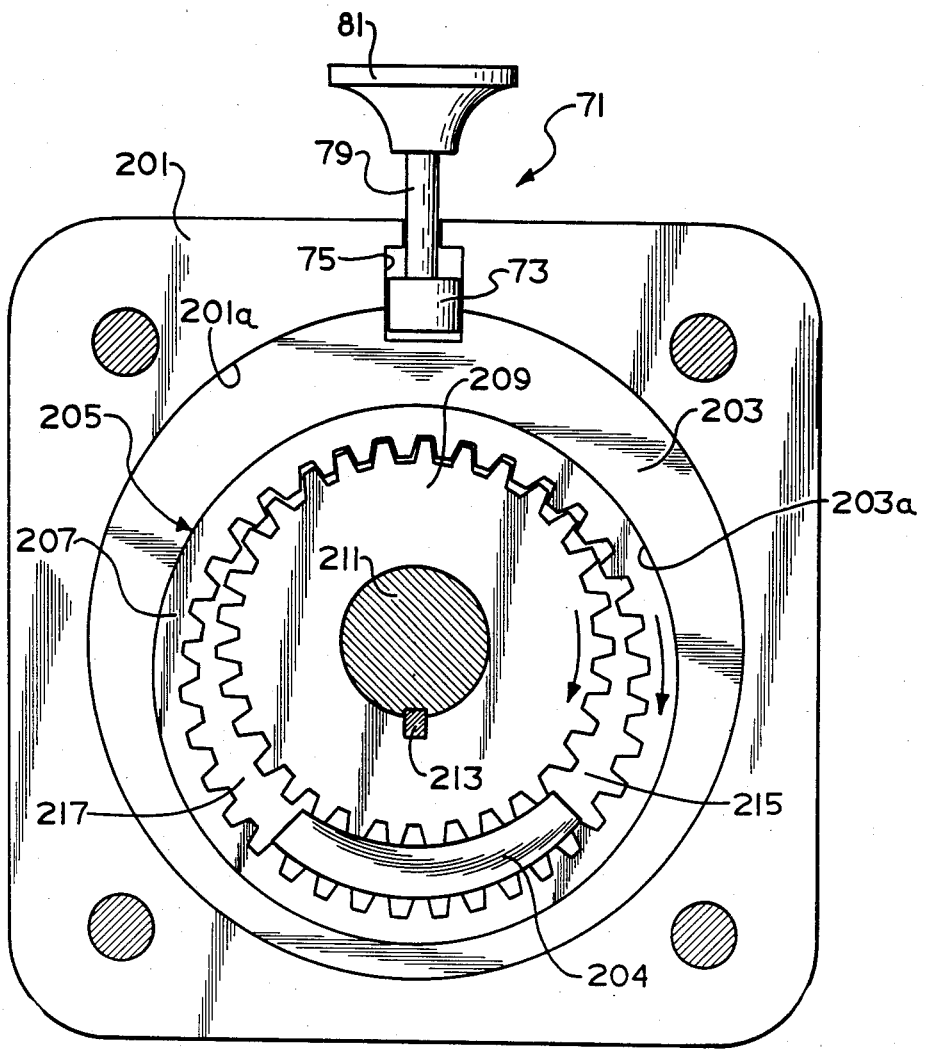
FIG. 5 is a transverse cross-section, similar in nature to FIG. 2, illustrating an alternative embodiment in which the present invention is applied to a displacement mechanism of the rotary crescent type.
Figure 6:
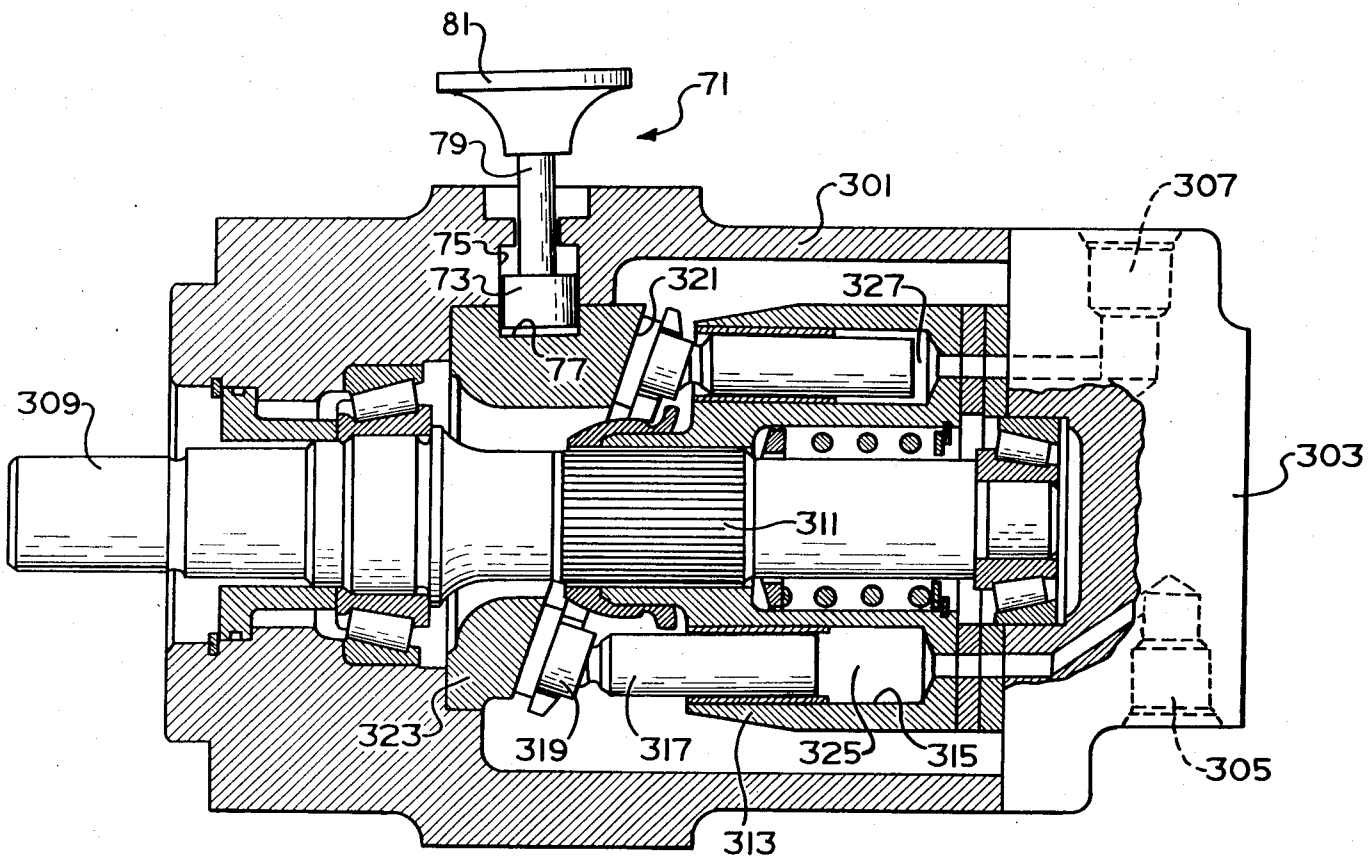
FIG. 6 is an axial cross-section of yet another alternative embodiment in which the present invention is applied to a motor in which the displacement mechanism is of the axial piston type.

Referring now to FIGS. 4–6, several other alternative embodiments of the present invention will be described. In these alternative embodiments, the present invention will be applied to different types of rotary fluid energy-translating displacement mechanisms, but it will be apparent to those skilled in the art that in each embodiment, the principles of operation described above in great detail will still be applicable. For ease of illustration and description, each of the embodiments of FIGS. 4–6 will include the same free-wheeling mechanism 71 illustrated and described in connection with the embodiment of FIGS. 1–3, and bearing the same reference numerals.

The device of FIG. 4 includes a housing member 101 which defines a generally cylindrical inner surface 101*a*. Disposed within the housing member 101 is an eccentric ring member 103, and disposed within the eccentric ring member 103 is a rotary assembly, generally designated 105. The rotary assembly 105 includes a rotor member 107, fixed for rotation with a shaft 109 by means of a key 111, the shaft 109 being rotatable about its own axis. The rotor member 107 defines a plurality of radially-oriented slots 113, and disposed in each of the slots 113 is a sliding vane member 115.

Rotation of the rotary assembly 105 within the eccentric ring member 103 results in the progressive formation of a plurality of expanding fluid volume chambers 117*a*, 117*b*, and 117*c*, as well as a pair of changeover fluid volume chambers 119*a* and 119*b*, then the formation of a plurality of contracting fluid volume chambers 121*c*, 121*b*, and 121*a*.

If the device shown in FIG. 4 were to the used as a motor, pressurized fluid would be ported through suitable ports (not shown) into the expanding volume chambers 117*a*, 117*b*, and 117*c*, which would cause rotation of the rotary assembly 105, while low pressure, exhaust fluid would be communicated from contracting volume chambers 121*c*, 121*b*, and 121*a*, through suitable ports (also now shown). At the same time, there is a reaction torque which is transmitted from the pressurized fluid to the portion of the eccentric ring member 103 which borders the expanding volume chambers 117*a*, 117*b*, and 117*c*. Thus, in the embodiment of the invention shown in FIG. 4, the eccentric ring member 103 comprises the reaction-torque-receiving means.

Referring still to FIG. 4, it may be seen that the eccentric ring member 103 defines the recess 77 which receives the engagement member 73 when the device of FIG. 4 is in its normal, operating position as shown in FIG. 4. When it is desired by the operator to permit the device to operate in the free-wheeling mode, the engagement member 73 may be moved to the disengaged position (similar to that illustrated in FIG. 3) which permits the eccentric ring member 103 to rotate with the rotary assembly 105, but without any of the expanding volume chambers 117*a–c* changing volume, and without any of the contracting volume chambers 121*a–c* changing volume.

Referring now to FIG. 5, there is illustrated another alternative embodiment in which the present invention is applied to a rotary crescent type of displacement mechanism. In the embodiment of FIG. 5, the device includes a housing member 201 which defines a generally cylindrical inner surface 201*a*. Disposed within the housing member 201 is an eccentric ring member 203 which defines a generally cylindrical inner surface 203*a*. Preferably formed integrally with the ring member 203 is a crescent member 204, the configuration and function of which is well known to those skilled in the art.

Disposed within the eccentric ring member 203 is a rotary assembly, generally designated 205, which includes an internally-toothed member 207 and an externally-toothed member 209 which is fixed for rotation with a shaft 211 by means of a key 213, the shaft 211 being rotatable about its own axis.

As is well known to those skilled in the art, the various types of displacement mechanisms illustrated and described herein can be used as either motor elements or pump elements, although the embodiment of FIGS. 1–3 is used primarily as a motoring element, and the embodiment of FIG. 4 was described in terms of being used as a motoring element. However, because the present invention is useful when used in conjunction with pumping elements also, the displacement mechanism of FIG. 5 will be described as a pumping element.

As is well known to those skilled in the art, when the crescent-type displacement mechanism of FIG. 5 is being utilized as a pump, rotary torque input is provided to the shaft 211 which rotates the externally-toothed member 209. Because the internally-toothed member 207 is in toothed engagement with the member 209, the members 207 and 209 both rotate (see arrows in FIG. 5). The teeth of the members 207 and 209 cooperate to define an expanding fluid volume chamber 215, which would be in fluid communication with an inlet port, while the teeth of the members 207 and 209 also cooperate to define a contracting fluid volume chamber 217, which would be in fluid communication with a fluid outlet port.

With the free-wheeling mechanism 71 disposed in the engaged position as shown in FIG. 5, the eccentric ring member 203 is fixed, i.e., is prevented from rotation relative to the housing member 201, and the crescent member 204 is fixed in its position shown in FIG. 5. In this normal, operating mode, rotation of the internally- and externally-toothed members 207 and 209 results in fluid being drawn into the expanding volume chamber 215, and a certain portion of the fluid is then carried by the teeth of the members 207 and 209 past the crescent member 204 into the contracting volume 217, resulting in pressurization of the fluid in the chamber 217 and in the outlet port.

If an operating condition is encountered in which there temporarily is no need for a flow of pressurized fluid from the volume chamber 217, and the operator wishes to conserve horsepower, the operator may move the handle 81 of the mechanism 71 to the disengaged position (corresponding to that shown in FIG. 3), which will then permit the eccentric ring member 203 to rotate freely relative to the housing member 201. Therefore, rotation of the shaft 211 will result in rotation of the members 207 and 209 and the ring member 203 and crescent member 204 as a unit within the housing member 201 with the result that the chamber 215 does not expand, the chamber 217 does not contract, and no fluid is displaced from the inlet port to the outlet port. While the device is in this free-wheeling mode, not displacing fluid, substantially less input horsepower is required to drive the shaft 211.

Referring now to FIG. 6, one final embodiment will be described in which the present invention is applied to a rotary fluid energy-translating displacement mechanism of the axial piston type. The device shown in FIG. 6 will be, like the embodiments of FIGS. 1–3 and FIG. 4, described as a motor element. Because axial piston motors of the type illustrated in FIG. 6 are quite well known, the device will be described only briefly. The axis piston device of FIG. 6 includes a housing member 301 to which is attached a port housing member 303. The port housing member 303 defines a high-pressure inlet port 305 and a low-pressure outlet port 307. Rotatably supported by the housing members 301 and 303 is an output shaft 309.

In splined engagement with a splined portion 311 of the output shaft 309 is a rotary cylinder barrel 313 which defines a plurality of axially-oriented cylinders 315. Disposed within each of the cylinders 315, and capable of moving axially therein, is a piston member 317. Each of the piston members 317 includes a slipper 319 which remains in sliding engagement with a slipper surface 321 of a fixed displacement swashplate 323.

With the device of FIG. 6 being utilized as a motor in its normal, operating mode, pressurized fluid is communicated through the inlet port 305 into a plurality of expanding fluid volume chambers 325, causing its respective piston member 317 to move to the left in FIG. 6, which, in turn causes rotation of the cylinder barrel 313 and output shaft 309 relative to the swashplate 323 and housing members 301 and 303. As the cylinder barrel 313 rotates, certain of the pistons 317 are caused by the configuration of the surface 321 to begin to move to the right in FIG. 6, thus creating a plurality of contracting fluid volume chambers 327. Low-pressure exhaust fluid is communicated from the chamber 327 through the outlet port 307, then back to either the pump or the system reservoir, as is well known in the art.

Therefore, with the axial piston motor of FIG. 6 in its normal, operating position, the pressurized fluid in the expanding volume chambers 325 transmits a reaction torque through the respective pistons 317 and slippers 319 to the swashplate 323 which, in the embodiment of FIG. 6, comprises the reaction-torque-receiving means when the mechanism 71 is in its engaged position, preventing rotation of the swashplate 323 relative to the housing 301.

If one or more of the axial piston motors of FIG. 6 are being used to drive the wheels of a vehicle, and the operator wishes to tow the vehicle, the free-wheeling mechanism 71 may be moved by the operator to its disengaged condition, thus permitting the swashplate 323 to rotate freely relative to the housing 301. In this free-wheeling mode of operation, the towing of the vehicle will result in rotation of the output shaft 309 which, in turn, will result in rotation of the cylinder barrel 313 and the plurality of pistons 317 and slippers 319. However, with the swashplate 323 now free to rotate, the barrel 313, pistons 317 and swashplate 323 will now rotate as a unit, and the expanding chambers 325 will not expand, nor will the contracting chambers 327 contract. Instead, all of the chambers will remain the same size, and no fluid will be displaced into or out of any of the cylinders 315. Thus, the output shaft 309 will be able to rotate freely without displacing fluid from the rotary assembly comprising the cylinder barrel 313 and pistons 317 and there will not be high-speed sliding engagement of the pistons 317 within the cylinders 315 and of the slippers 319 along the slipper surface 321, both of which would generate substantial heat and cause wear and potential damage.

The present invention has been described in connection with several different embodiments, and in detail sufficient to one skilled in the art to make and use the same. It is believed that upon a reading and understanding of the foregoing specification, various alterations and modifications will become apparent to those skilled in the art, as well as various other alternative uses of the present invention, and it is intended to include all such alterations, modifications, and embodiments as part of the invention, insofar as they come within the scope of the appended claims.

I claim:

1. A rotary fluid pressure device of the type including housing means defining inlet means and fluid outlet means; a rotary fluid energy-translating displacement means associated with said housing means and including a rotary assembly and a normally stationary reaction-torque-receiving means, operably associated with said rotary assembly and with said housing means whereby, when said reaction-torque-receiving means is stationary, rotation of said rotary assembly defines expanding and contracting fluid volume chambers, said rotary fluid energy-translating displacement means comprising a means of the type wherein said normally stationary reaction-torque-receiving means defines a fluid chamber, and said rotary assembly is disposed within said reaction-torque-receiving means to separate said fluid chamber into said expanding and contracting fluid volume chambers in response to said rotation of said rotary assembly; means operable to communicate fluid from said fluid inlet means to said expanding fluid volume chambers and from said contracting fluid volume chambers to said fluid outlet means; input-output shaft means and means operable to transmit torque between said input-output shaft means and said rotary assembly; characterized by:

(a) an engagement member operably associated with said housing means and said normally stationary reaction-torque-receiving means; and (b) actuation means operably associated with said engagement member and operable to move said engagement member between:

(i) a first position in which said engagement member is disposed to prevent rotational movement of said reaction-torque-receiving means relative to said housing means, whereby said rotary assembly has said normal rotation to define said expanding and contracting fluid volume chambers; and (ii) a second position in which said engagement member is disposed to permit rotational movement of said reaction-torque-receiving means relative to said housing means, whereby rotation of said rotary assembly does not result in the normal relative movement between said reaction-torque-receiving means and said rotary assembly, and said fluid volume chambers do not expand and contract.

2. A rotary fluid pressure device as claimed in claim 1 characterized by said valve means comprising a normally stationary valve member defining a plurality of normally stationary fluid passages in fluid communication with said expanding and contracting fluid volume chambers.

3. A rotary fluid pressure device as claimed in claim 2 characterized by said normally stationary valve member comprising a valve plate operable to rotate relative to said housing means, said valve plate defining said normally stationary fluid passages, and means for connecting said valve plate for rotation with said reaction-torque-receiving means when said engagement member is in said second position.

4. A rotary fluid pressure device as claimed in claim 1, characterized by said rotary fluid energy-translating displacement means comprising an internal gear set, said reaction-torque-receiving means comprising an internally-toothed outer gear member and said rotary assembly comprising an externally-toothed inner gear member.

5. A rotary fluid pressure device as claimed in claim 4, characterized by said device further comprising a housing member associated with said housing means and defining a generally cylindrical inner surface, said outer gear member being disposed within said cylindrical inner surface of said housing member.

6. A rotary fluid pressure device as claimed in claim 5, characterized by said engagement member being operably associated with said housing member and with said internally-toothed outer gear member, said first position comprising said engagement member preventing rotational movement of said outer gear member relative to said housing member, and said second position comprising said engagement member permitting rotational movement of said outer gear member relative to said housing member.

7. A rotary fluid pressure device as claimed in claim 1 characterized by said normally stationary reaction-torque-receiving means comprising an eccentric ring member defining a cam surface, said cam surface defining said fluid chamber and said rotary assembly comprises a rotor member and a plurality of vane members normally operable to engage said cam surface during rotation of said rotary assembly.

8. A rotary fluid pressure device as claimed in claim 1 characterized by said normally stationary reaction-torque-receiving means comprising an eccentric ring member, and said rotary assembly comprising an internally-toothed member and an externally-toothed member eccentrically disposed therein, said toothed members being in toothed engagement with each other and defining therebetween a crescent-shaped space, said eccentric ring member further comprising a crescent member disposed in said crescent-shaped space to separate said crescent-shaped space into said expanding and contracting fluid volume chambers.

9. A rotary fluid pressure device of the type including housing means defining fluid inlet means and fluid outlet means; a rotary fluid energy-translating displacement means associated with said housing means and including an internally-toothed assembly and an externally-toothed member eccentrically disposed within said internally-toothed assembly, and normally having orbital and rotational movement relative thereto, the teeth of said members normally interengaging to define expanding and contracting fluid volume chambers during said orbital and rotational movement; valve means normally operable in response to at least one of said movements to communicate fluid from said fluid inlet means to said expanding fluid volume chambers and from said contracting fluid volume chambers to said fluid outlet means; input-output shaft means and drive shaft means operable to transmit torque between said input-output shaft means and said externally-toothed member; characterized by:

(a) said internally-toothed assembly comprising a housing member associated with said housing means and defining a generally cylindrical inner surface, and an internally-toothed member rotatably disposed within said cylindrical inner surface of said housing member;

(b) an engagement member operably associated with said housing member and said internally-toothed member; and (c) actuation means operably associated with said engagement member and operable to move said engagement member between:

(i) a first position in which said engagement member is disposed to prevent rotational movement of said internally-toothed member relative to said housing member, whereby said externally-toothed member has said normal orbital and rotational movement relative to said internally-toothed member to define said expanding and contracting fluid volume chambers; and (ii) a second position in which said engagement member is disposed to permit rotational movement of said internally-toothed member within said cylindrical surface of said housing member, whereby rotation of said externally-toothed member does not result in any relative movement between said internally-toothed member and said externally-toothed member, and said fluid volume chambers do not expand and contract.

10. A rotary fluid pressure device as claimed in claim 9 characterized by said rotary fluid energy-translating displacement means comprising a gerotor gear set, said internally-toothed member comprising a gerotor ring having a plurality $N+1$ of internal teeth, and said externally-toothed member comprising a gerotor star having a plurality N of external teeth.

11. A rotary fluid pressure device as claimed in claim 10, characterized by said valve means comprising a normally stationary valve member defining a plurality $N+1$ of normally stationary fluid passages, each of said normally stationary fluid passages being in fluid communication with one of said fluid volume chambers, said valve means further comprising a rotary valve member defining a plurality N of valve passages, said rotary valve member rotating at the speed of rotation of said gerotor star, the resulting communication between said rotary valve passages and said stationary fluid passages comprising low-speed, commutating valving.

12. A rotary fluid pressure device as claimed in claim 11 characterized by said normally stationary valve member comprising a valve plate operable to be rotatable relative to said housing means, said valve plate defining said normally stationary fluid passages, and means for connecting said valve plate for rotation with said internally-toothed member when said engagement is in said second position.

* * * * *